United States Patent [19]

Allread et al.

[11] Patent Number: 4,598,759

[45] Date of Patent: Jul. 8, 1986

[54] APPARATUS FOR AUTOMATED MIXING AND TRANSPORT OF CHEMICALLY BONDED SAND MIXTURES FOR CASTING

[75] Inventors: James J. Allread, Hartland; Donald C. Lenz, Mukwonago, both of Wis.

[73] Assignee: Grede Foundries Inc., Milwaukee, Wis.

[21] Appl. No.: 572,353

[22] Filed: Jan. 20, 1984

[51] Int. Cl.[4] ..... B22C 5/04; B22C 25/00

[52] U.S. Cl. ..... 164/155; 141/94; 164/456; 366/29; 366/132

[58] Field of Search ..... 164/155, 456, 154; 141/94; 366/29, 132

[56] References Cited

U.S. PATENT DOCUMENTS 2,695,431 11/1954 Davis ..... 164/456 X
4,121,646 10/1978 Rikker ..... 164/456

FOREIGN PATENT DOCUMENTS 1200496 7/1970 United Kingdom ..... 366/29
2089700A 6/1982 United Kingdom ..... 366/132

*Primary Examiner*—Nicholas P. Godici
*Assistant Examiner*—J. Reed Batten, Jr.
*Attorney, Agent, or Firm*—Andrus, Sceales, Starke & Sawall

[57] ABSTRACT

A central mixer is coupled to a transport bucket which moves from a home position to anyone of a number of core machines. An automated computer-based logic controller monitors the state of all core machines and responds to an appropriate demand signal from each core machine, with a priority response. The controller selects the proper mix recipe and prepares a sand mix of sand, binder and other additives in timed relation to the position of the transport bucket. The bucket is moved to receive the sand mix and delivers it to the proper core machine, and then activates the core machine, with maximum and efficient usage of the system. The available sand mix recipes are placed in the controller memory for the particular core box machines. The controller operates a series of timers to deliver sand weight, powder additives in sequence, and the necessary binder. Internal checks insure that the sand, powder additive and binder timers have properly operated before a "mull" timer establishes thorough mixing. The sand mixer continues to cycle to introduce an appropriate batch into the transport bucket. The bucket initiates a timer which is preset to the estimated return time to the mixer, and a mixer cycle starts only when the mixer time is less than or equal to such return time.

18 Claims, 20 Drawing Figures

APPARATUS FOR AUTOMATED MIXING AND TRANSPORT OF CHEMICALLY BONDED SAND MIXTURES FOR CASTING

BACKGROUND OF THE INVENTION

This invention relates to the manufacture of sand cores and molds for casting of metal products and particularly to a method and apparatus for production of cores and molds of widely differing specifications.

In the casting of a product, a core and/or mold is formed of sand and a binder to define a cavity in accordance with the desired product shape. The method and apparatus may be applicable to either a core or a mold and is described hereinafter with reference to a core for simplicity of description. For high quality casting processes, various binders and additives may be mixed with the sand prior to its introduction into the core box. Suitable activating materials or processes are then introduced to the sand mix at the core box to activate the binder within the sand core and thereby complete the casting of the sand core. In a production foundry, sand is mixed with appropriate binder and additive materials at one station and then distributed to the appropriate core box by a suitable distribution system. The recipe of materials is significant and equally important is accurate combining of the several components. For mass production processes, it is also important to maintain a continuous flow of material in a rapid and efficient manner.

The different casting processes may require different mixes of sand, binder and various additives. Although the batches for different products may use the same basic ingredients, the relative gerantiter will change. Further, different binders may be used. For example, sodium silicate gas and ISOCURE are two generic families of binders used in the sand mix for forming of cores and molds for sand casting. Certain sand casting mixes are activated by $CO_2$ gas while others are set by DMEA gas. Additives are often required to produce the desired finish to the final casting to control the flow ability of the sand into the core box, the hardness of the core and the like. Sand coremaking is in fact a highly developed art. Although basic mixes are similar, a proper core mix is extremely complex with each factor critical to a final mix. Further, the particular mix is not directly subject to analytical determination but also includes much empirical information. The number of recipes for core mixes is therefore voluminous, and is often based on know-how and experience related to a particular casting process and product. As a result, the core making process has required much care and attention.

There is a need for an efficient and cost effective automated sand core forming process and apparatus which can be applied in the environment of a sand core forming operation.

SUMMARY OF THE INVENTION

The present invention is particularly directed to a sand mixing apparatus and method incorporating an automated computer-based logic control for controlling the mixing of the sand and binder and other additives and transfer of the sand mix to an appropriate core box, with activation of the sand mix in the core box. The present invention has been found to be particularly adapted to the improvement in sand core mix control and in the high grade production of batch core mix. Generally in accordance with the present invention, a central mixer unit is provided for producing any one of the various available recipes and with an automated conveyor for transfer of the sand core mix to one of a plurality of core machines under the control of a computer-based logic controller. A transport bucket or other suitable conveying means is movable between a reset or home position at the sand mixer and the general core machines. For purposes of description, a conveyor bucket is hereinafter described. The controller monitors the state of all core machines and responds to an appropriate demand signal from each core machine, and is preferably programmed to select the machine with the highest priority. The controller thus selects the proper mix recipe and prepares the proper quantity and mixture of the sand mix for the particular core machine. The controller is also coupled to the conveyor to establish a conjoint control of the position and operation of the conveyor to receive the proper sand mix, deliver the sand mix to the proper core machine, and to control the core machine. The controller continues to respond to all the demand signals to service the core machines and thereby insure maximum and efficient usage of the system.

More particularly, in a batch system using a timed movement of the several operating components of the same, the controller holds the mixer off and in standby with a basic unit of clean sand in the mixer until a demand signal is received. Each core machine has a demand signal means coupled to the controller to signal a demand for a sand mix. The controller, on demand, initiates the mixer cycle, by placing the appropriate recipe into the program along with the mix quantity for the core machine to be serviced. The available recipes are of course placed in the controller memory which may be on selected basis, with an interactive program used by the operator to preset the proper and optimum recipe for a particular core box. Upon entry of a recipe, the sand mixer is automatically controlled to provide appropriate combinations and mixing of sand, binder and other additives. If there is no demand for a sand mix, the mixer is shut down and awaits a call. If a demand arises while the mixer is running, the mixer, of course, continues to operate.

Upon receiving a signal for a sand mix, the controller determines whether or not additional sand must be added, and if so, initiates a timed discharge of sand, and the controller also stops to add powder additive required, and if so, initiates one or more powder additives in sequence to correspondingly add the appropriate powder. This supply of sand and additive may be for a fixed period set by an appropriate sand timer and powder timer. If no powder is necessary, the controller stops to add the necessary binder by actuation of a binder timer, after a time delay. The binder timer cannot respond unless both the sand and the powder additive timers have timed out and a binder delay timer has also timed out. The delay timer is actuated upon completion of the powder additive to delay the addition of the binder.

Assuming the mix is proper, the binder is added for the appropriate period, after which a further delay timer may be actuated to once again permit the proper and thorough mixing. Then, a second binder cycle of the same sequence as the first is provided to add the second binder part when needed. The controller then automatically initiates a "mull" timing cycle during which period the mixture is thoroughly agitated and mixed within the mixer.

The sand mix continues to cycle to introduce an appropriate batch into the transport bucket, which is then automatically actuated to move to the proper core station, open its discharge gate and place the specified mix, under control by a timer, into the proper core hopper or other core machine storage unit, then closes and returns to the mixer position. When the core machine is activated, the controller introduces the proper activating means to complete the formation of the sand mold.

To prevent erroneous core machine selection, the controller may and preferably does select the highest priority signal and then locks out all other priority signals until the mixer has discharged the sand mix to the conveyor.

The sand bucket upon leaving a core machine initiates a timer which is preset to correspond to the estimated time for the bucket to move back to the mixer. The mixer compares the time to mix a sand batch with respect to the estimated time of arrival of the bucket. The controller initiates a mixing cycle for such machine only when its mixing time is less than or equal to the transport time of the transport bucket.

The mixer thus stops and only restarts when a core machine demand is within the return time, or when the bucket has returned to the mixer. The mixer, upon resetting to permit a further mixing cycle, may again load clean sand under the control of a clean sand timer to set the mixer with a minimum starting quantity.

The system may be constructed with a normal maximum batch size. If a larger total batch is required, the controller includes means such as a batch counter to establish a plurality of loading mixing cycles at the mixer before the bucket is released for transfer to the core machine. The system preferably includes a cleaning cycle which may be under a clean timer control to clean the mixer when a demand signal does not exist. If a demand for sand is initiated during the cleaning period, the timer may be automatically cancelled and the system cycled from the beginning. The system preferably also includes a minimum and maximum quantity monitor for the several mix components such that if the quantity is below or above such limit the system will not continue to operate. The system may also provide means to automatically transfer a mix component from a bulk storage means to a supply storage unit. The powder and binder to be added may be a percentage of the sand quantity. The controller thus uses the sand weights for the core machine and the known stored percentage to permit the quantity of powder and/or binder to be added to the mix. A fast powder feed and a slow powder feed are provided and are selected depending upon the quantity to be added.

In operation, the sand, additives and binder are all predetermined quantities in a set of recipes and all recipes are stored with means for directly introducing any desired recipe into the system. In addition to the proper additives, the proper "mull" time, discharge time and transport times are preset as well as the gas blow and purge time of the core box or machine to create a total core forming line having automated timed control of the several components. The proper addition of the materials and particularly the powder and binders for any particular core is highly critical. Consequently, this system must provide the proper timing and control such that a proper mix is obtained. The information in the recipe is based not only on analytical data but empirical data to establish optimum conditions, resulting in the wide variety of core mixes. The present system provides for precise core processing with minimum personnel errors and increased production efficiency.

The present invention thus provides an improved programmed control method and apparatus for the mixing and transport of the sand mix for customized formation of cores or molds wherein the mix for the core or mold is uniquely based on a substantial number of different recipes, each of which includes values and combinations reflecting significant experience based on prior application and construction of cores or molds to establish the necessary strength and quality. The mixing is accurately controlled to provide precise amounts of the basic materials and the additives with appropriate intermixing of the materials and with a programmed transfer to the several core machines for appropriate dispensing and activation.

BRIEF DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
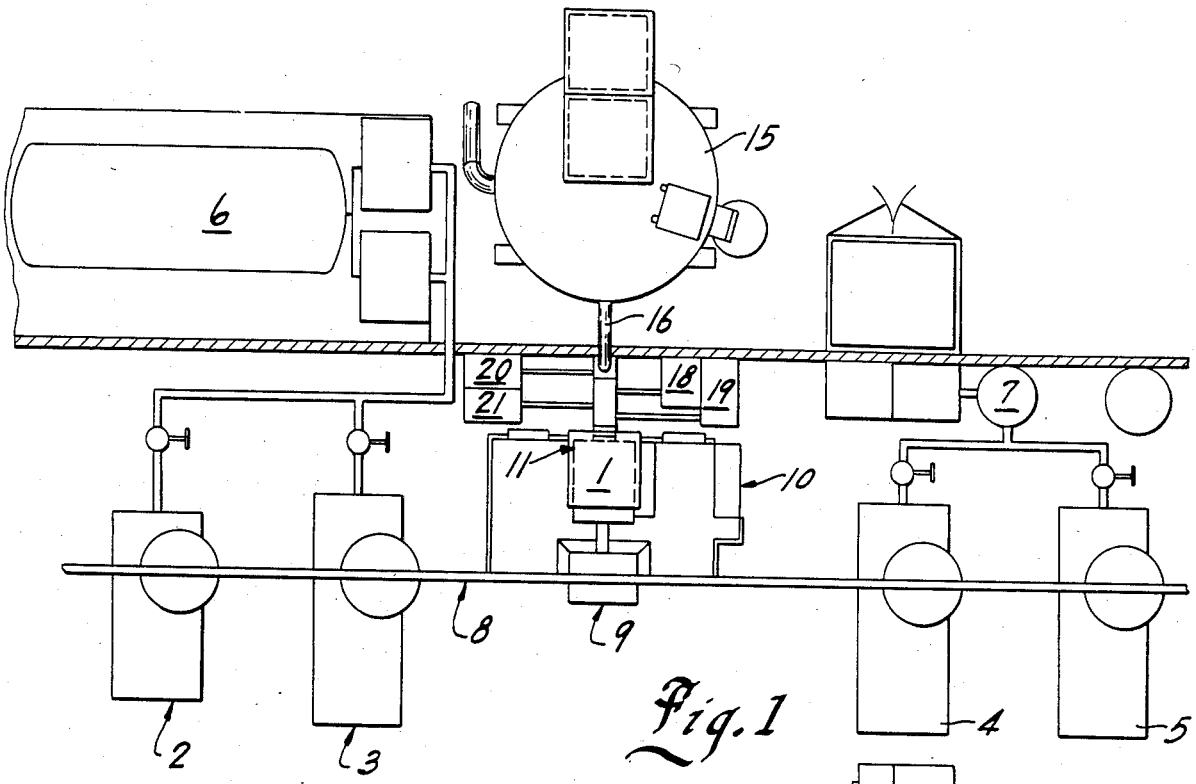
FIG. 1 is a simplified plan view of a core forming system.
Figure 2:
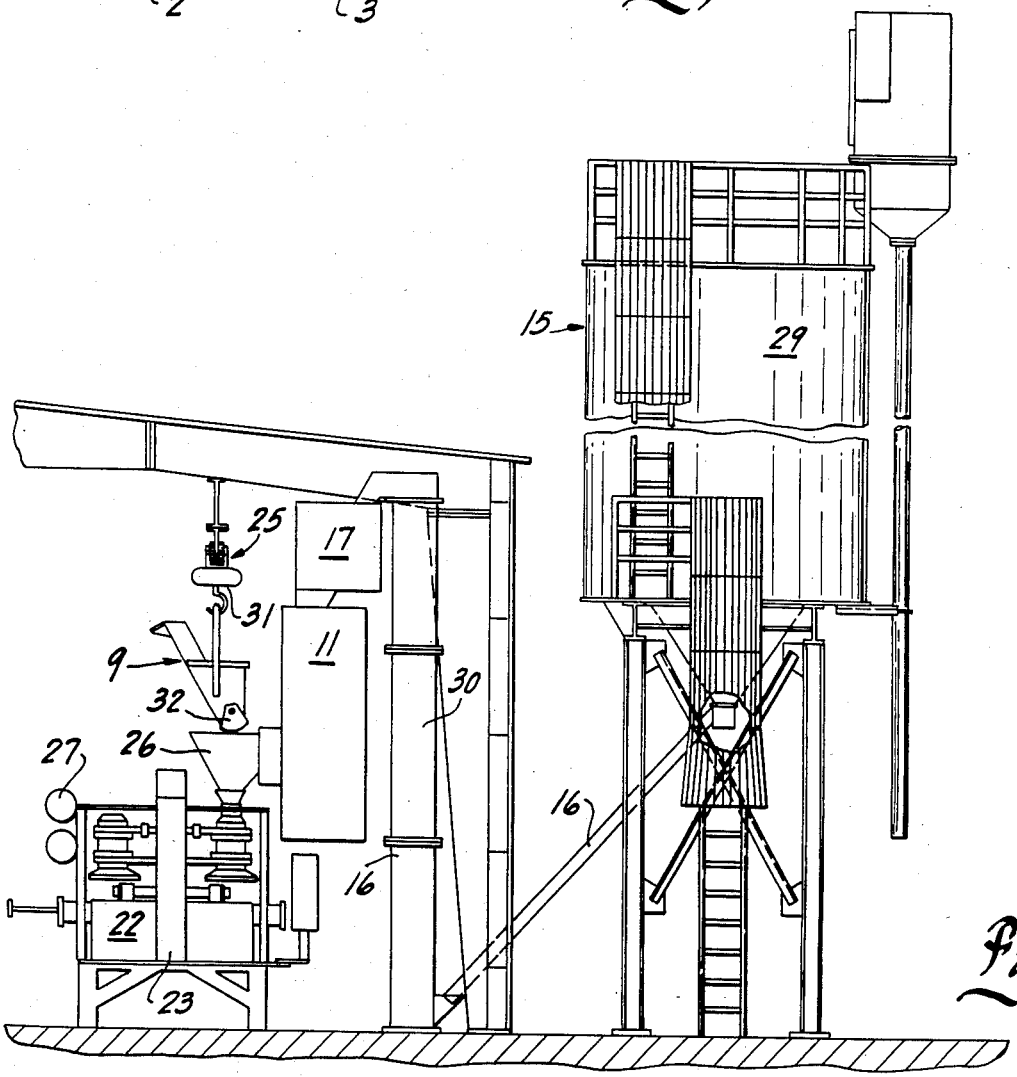
FIG. 2 is an enlarged side elevational view illustrating a mixer and bucket transport apparatus.

Referring to the drawings and particularly to FIGS. 1 and 2, a customized mold forming system is shown including a mixer station 1 which is centrally located between a plurality of core machines 2, 3, 4 and 5. The core machines 2–5 are shown longitudinally aligned and spaced with two machines to opposite ends of the mixer. The core machines 2 and 3, shown to the left side of the sand mixer in FIG. 1, are adapted to receive a core mix which is activated by a suitable gas such as $CO_2$. A liquid carbonate source 6 is shown mounted adjacent core machines 2 and 3 and is selectively connected to the core machines. The core machines 4 and 5 are adapted to receive a different activating gas, such as DMEA gas. A suitable supply or source 7 of such a gas is located adjacent to the core machines 4 and 5. A conveyor assembly 8 is shown extending the length of the line of core machines 2–5 and includes a transport bucket 9 for movement from the mixer station 1 to any one of the core machines 2–5 for delivery of the appropriate sand mix to each particular core machine. In accordance with the present invention, a computer-based logic controller 10 is provided for automatically controlling the operation of a mixer 11 at station 1 to mix and supply the appropriate core mold sand recipe or mixture of material to the transport bucket 9, to automatically move the filled bucket 9 to a core machine 2–5, and also to return the transport bucket to the mixer 11. The logic controller 10 may be of any suitable construction but is preferably a computer-based controller and is so shown and described. The controller 10 can be constructed to internally store a very substantial number of recipes or have input means for selective input from a suitable separate storage unit. The sand mix for any particular application can have substantial variations depending upon the particular specifications and use. Such information is generally developed as a result of prior core making production and processes and generally results in voluminous records relating to proper mixes within any given production facility. The computer-based logic controller permits the convenient storing of all such recipes which, when combined with the control of the sand mixing and distribution system, provides a reliable but relatively simple means of mass producing cores at a reasonable cost. For example, in a particular foundry, a recipe is available for various production runs.

The illustrated mixing system is a batch process. A sand source 15 is mounted at the mixing station 1 and includes a discharge or transfer unit 16 for supplying clean sand to sand mixer 11 through a top mounted preheater 17. In addition, sources, shown as two, of appropriate powder additives 18 and 19 are mounted with respect to the sand mixer 11 and operable to add different powders to the sand mix within the mixer. The binder is a two part material and sources 20 and 21 for each part are shown. Although each recipe for a core machine is formed from a relatively small number of basic components, the proportions of the respective items, however, are highly significant and many times critical.

Each of the core machines may be a well-known conventional device including a box-like mold support 22 having a shaping mold pattern 23. The sand mixture is deposited into the box to enclose the mold pattern such that upon firing and setting of the sand mix, a mold which conforms closely and concisely to the shape of the pattern is obtained. The pattern is then removed in accordance with conventional procedures. Each core machine may be manually monitored by an operator such that the proper recipe is selected for the core box placed in that machine. The operator may thus insert the proper recipe number for that core box. During the production, the operator may also manually control the cycle of each machine by actuating a start switch such as a pushbutton to initiate the demand for the sand mix after which the process proceeds as hereinafter described.

With the material thoroughly mixed in the sand mixer 11, the sand mix is deposited in the transport bucket 9 for delivery to the core machines.

Figure 3:
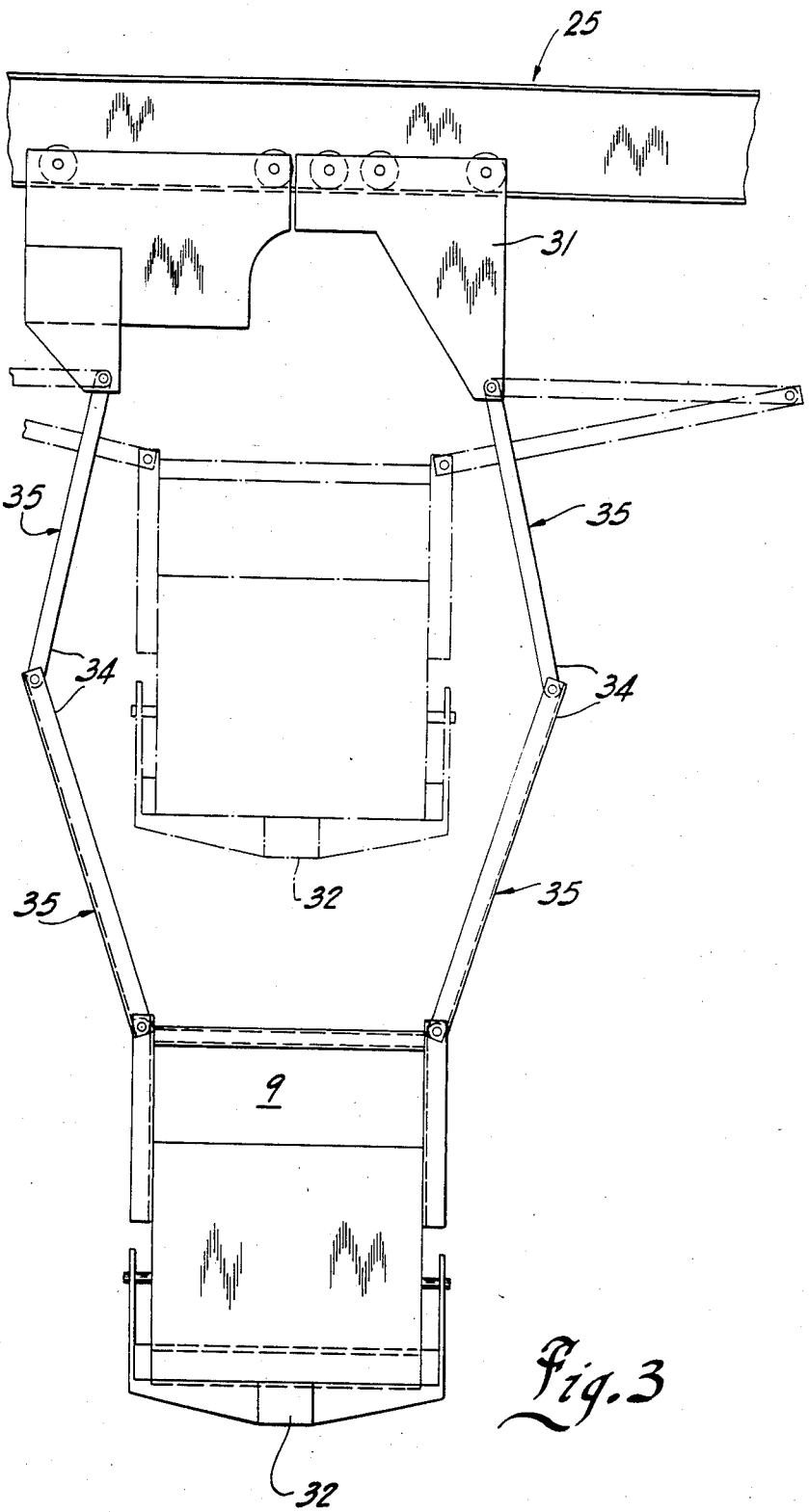
Figure 5A:
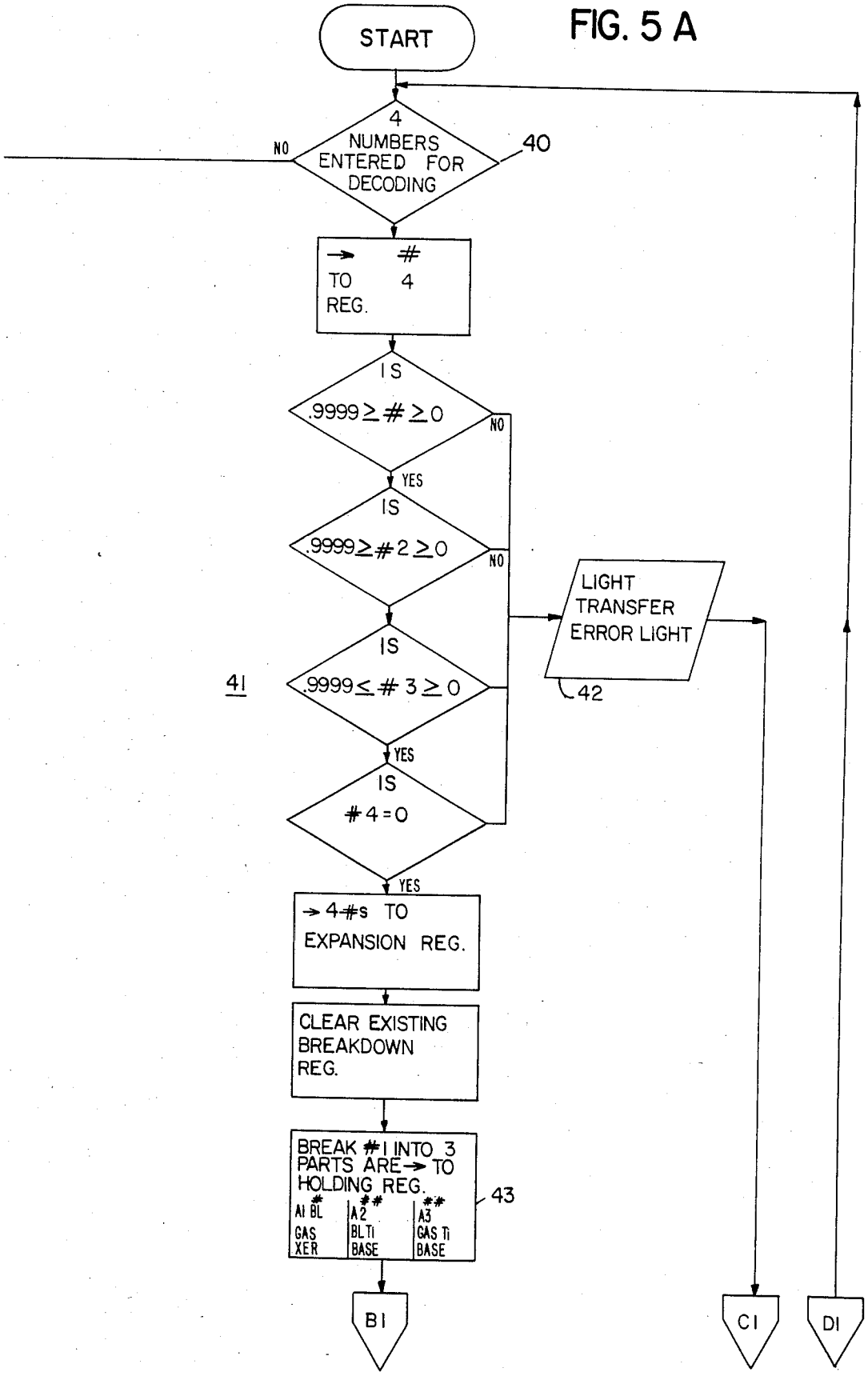
FIGS. 5A through 5H are a flow chart which set forths one program for selecting the sand mix for a selected core machine or box.
Figure 5B:
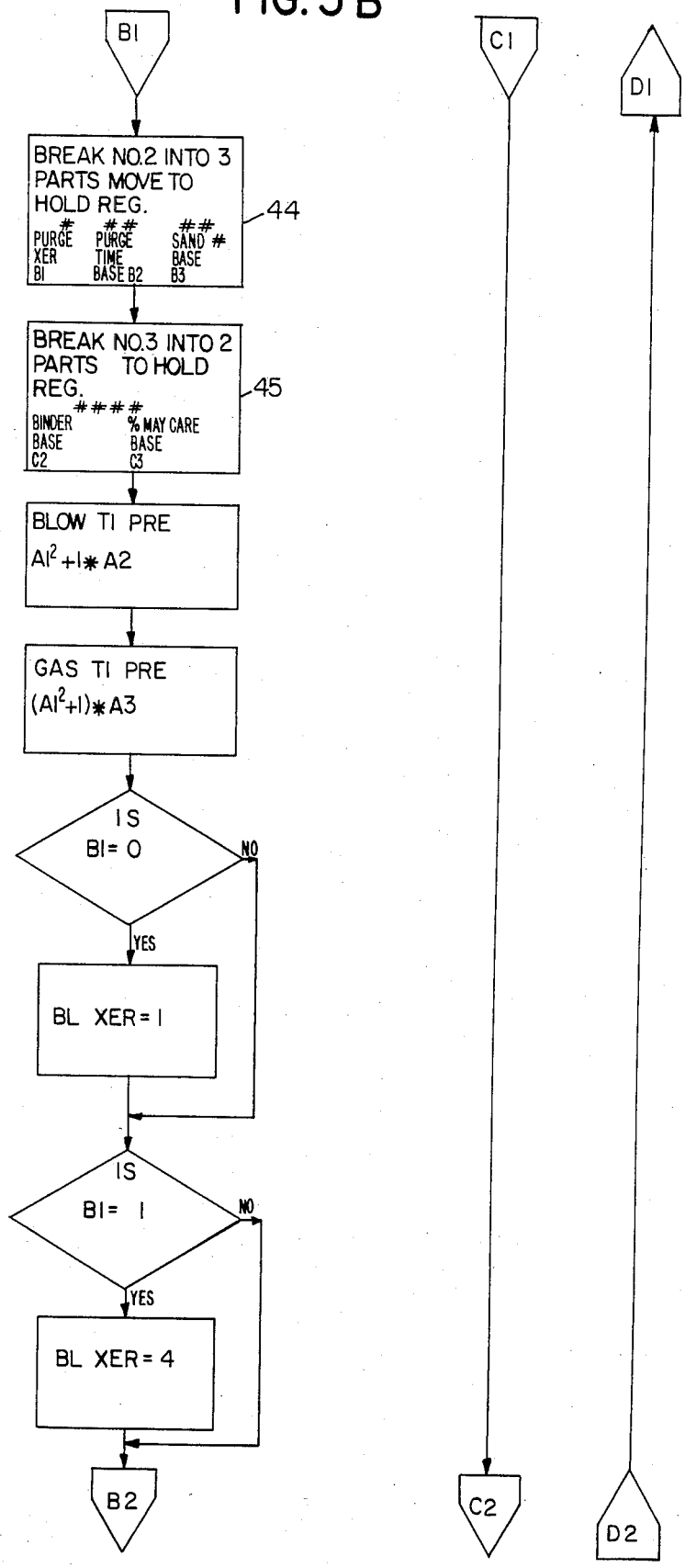
Figure 5C:
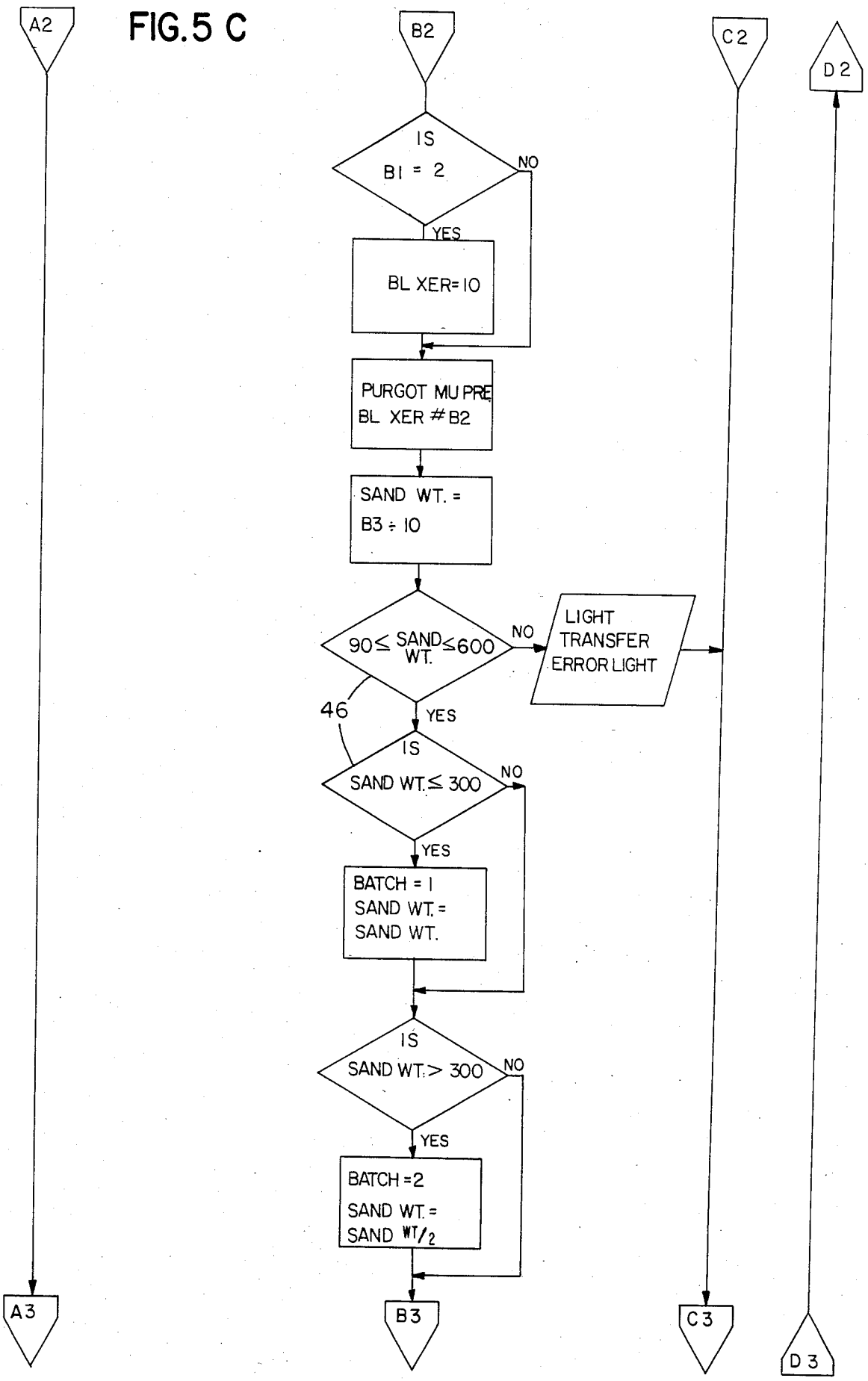
Figure 5D:
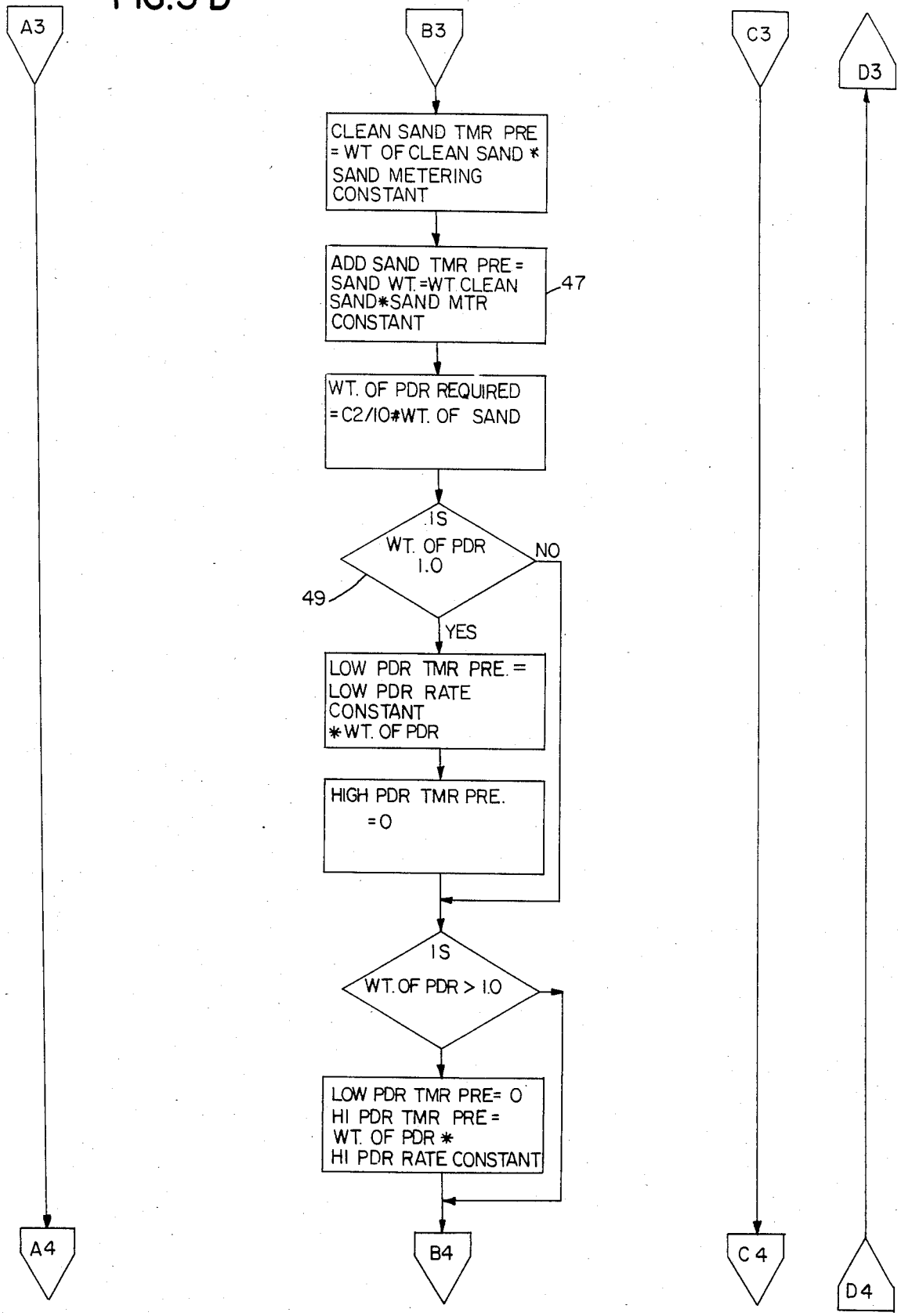
Figure 5E:
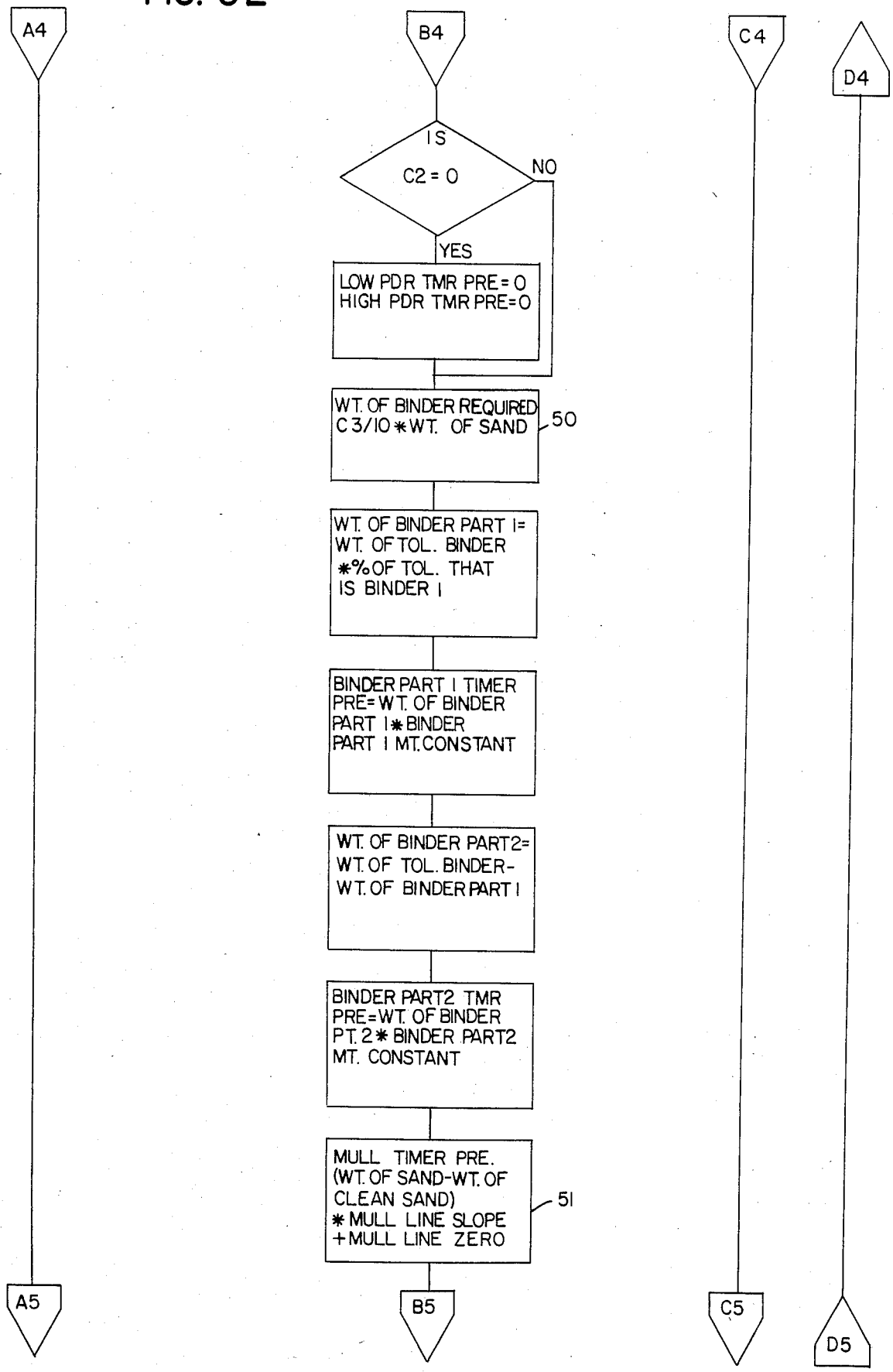
Figure 5F:
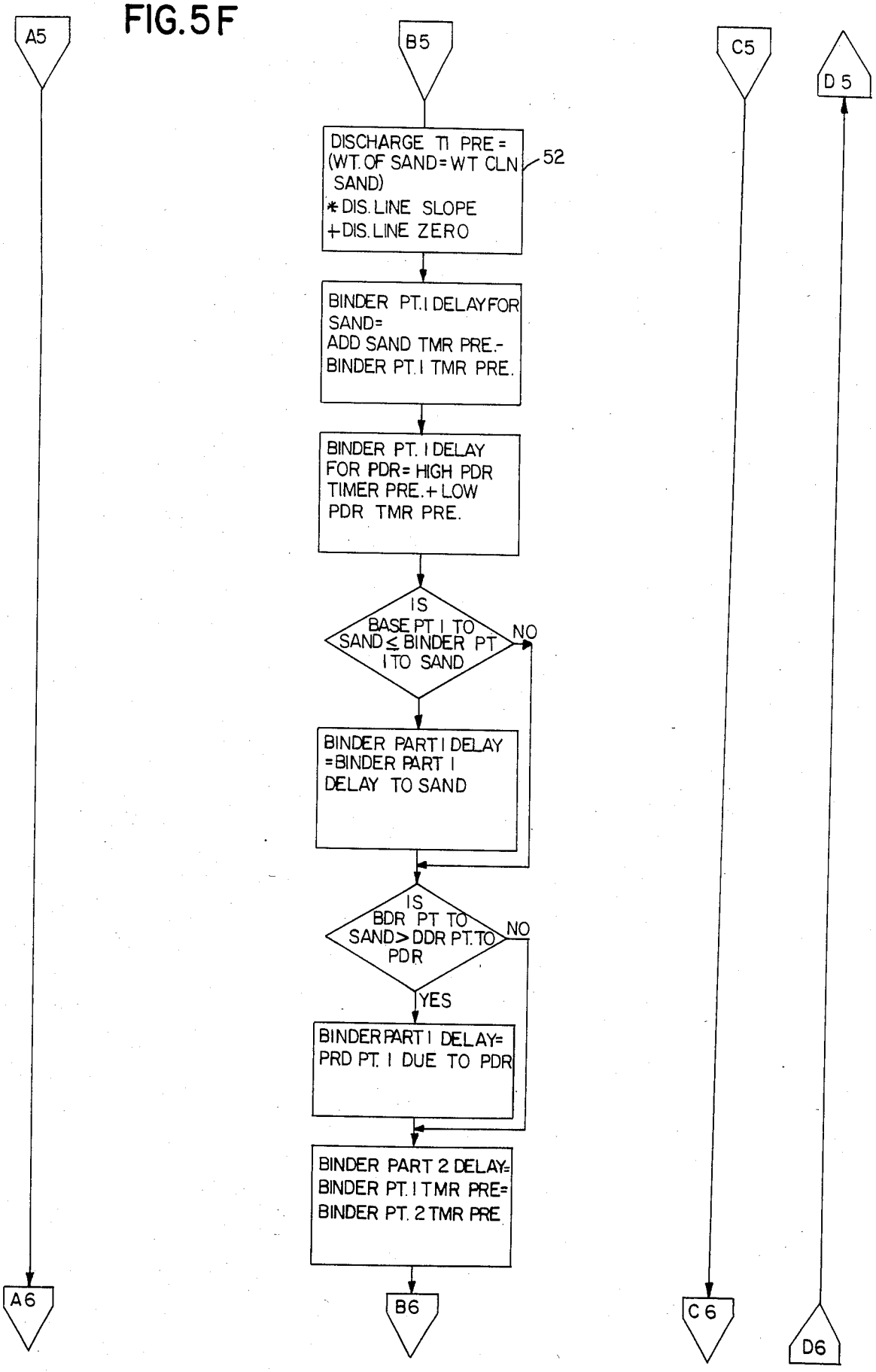
Figure 5G:
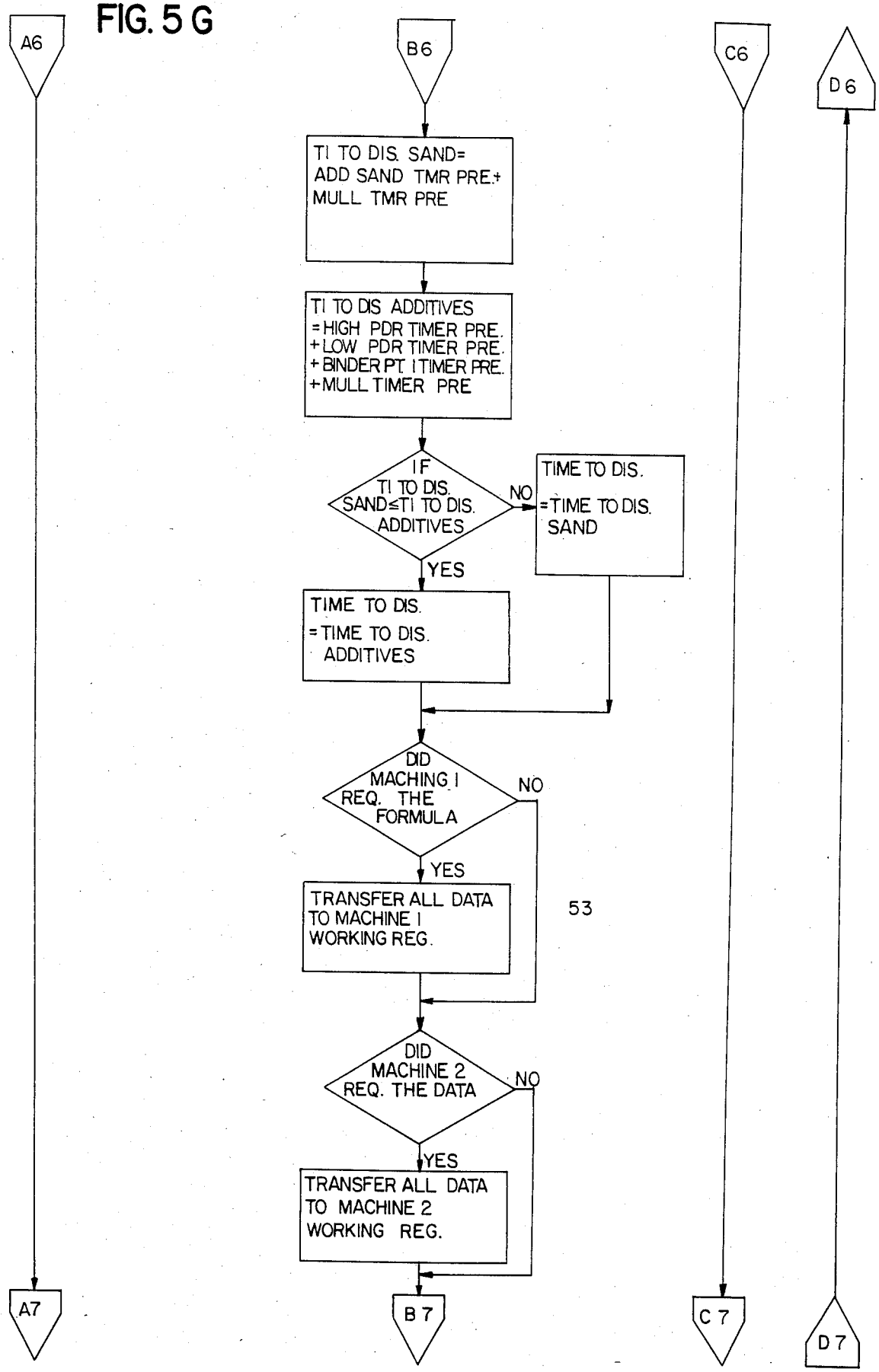
Figure 5H:
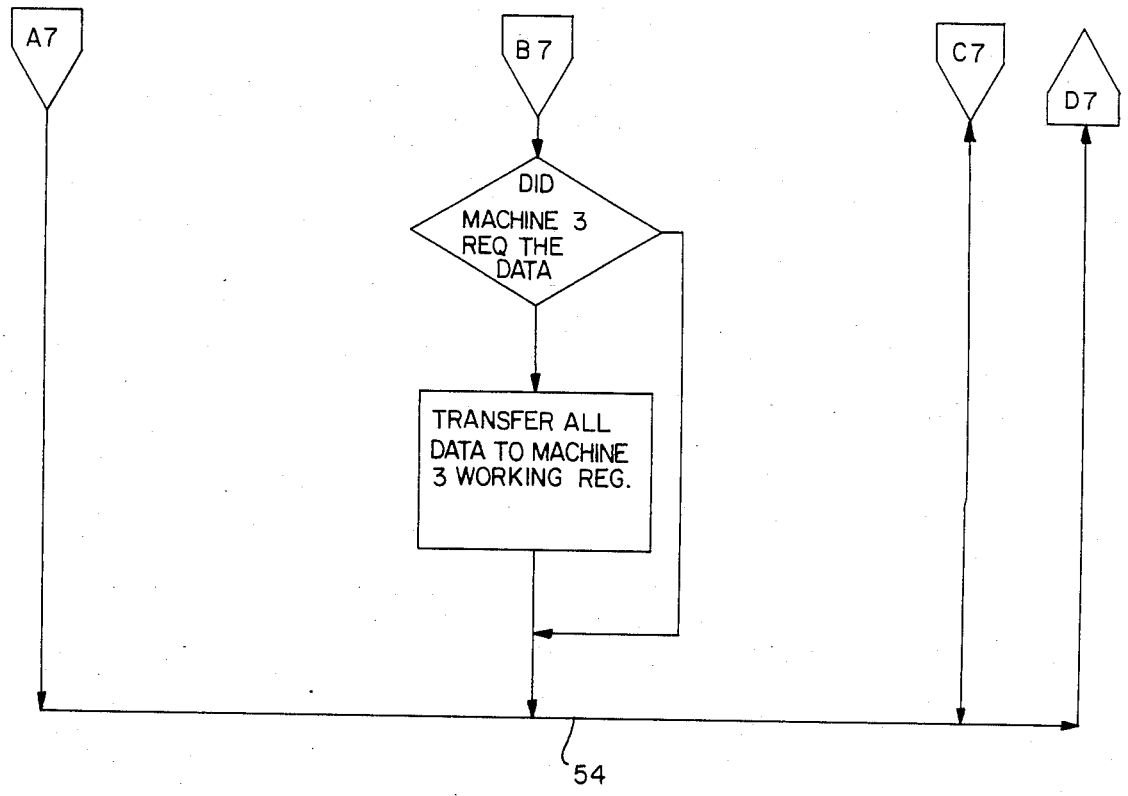
Figure 6A:
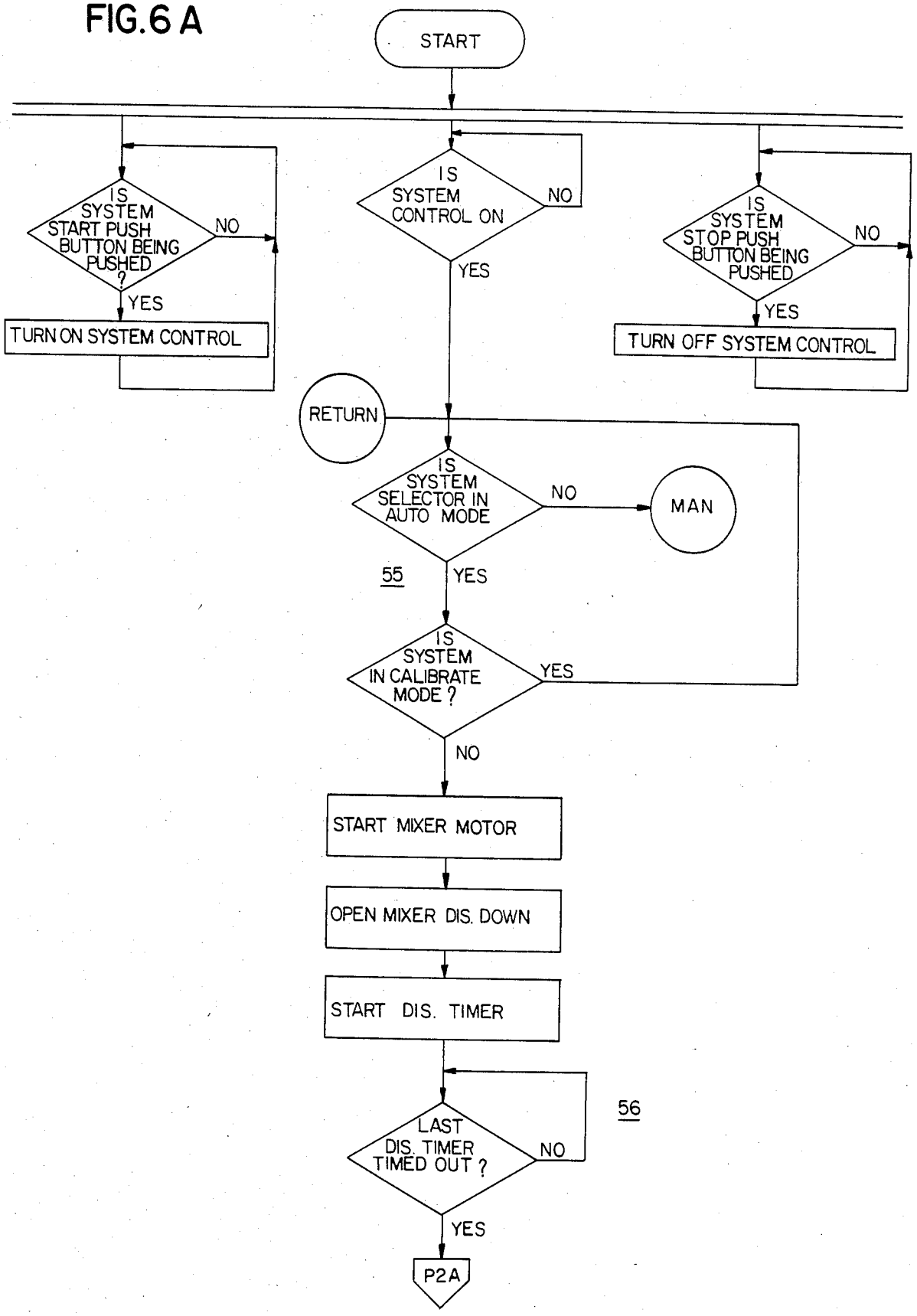
FIGS. 6A through 6H are a flow chart which set forths one program for the sand operation of a sand mixing apparatus and transfer system.
Figure 6B:
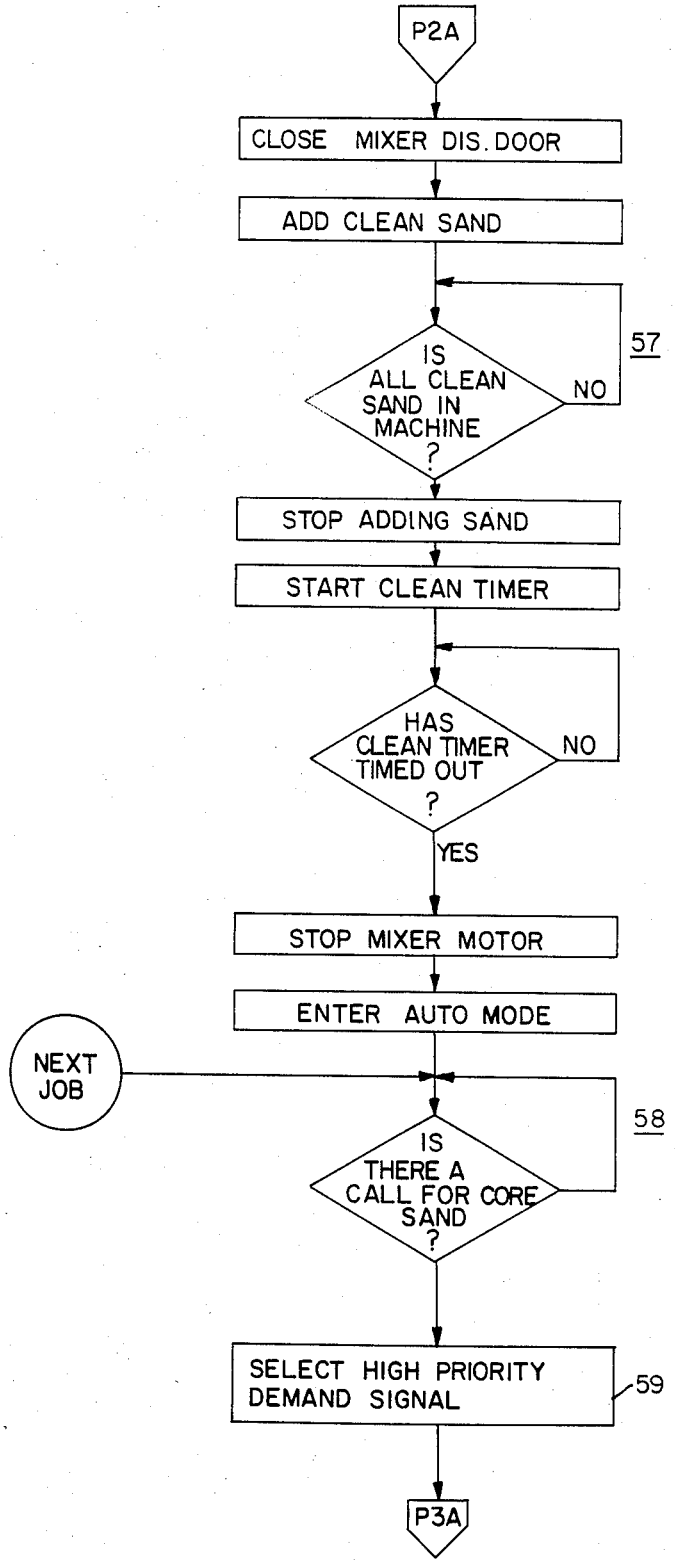
Figure 6C:
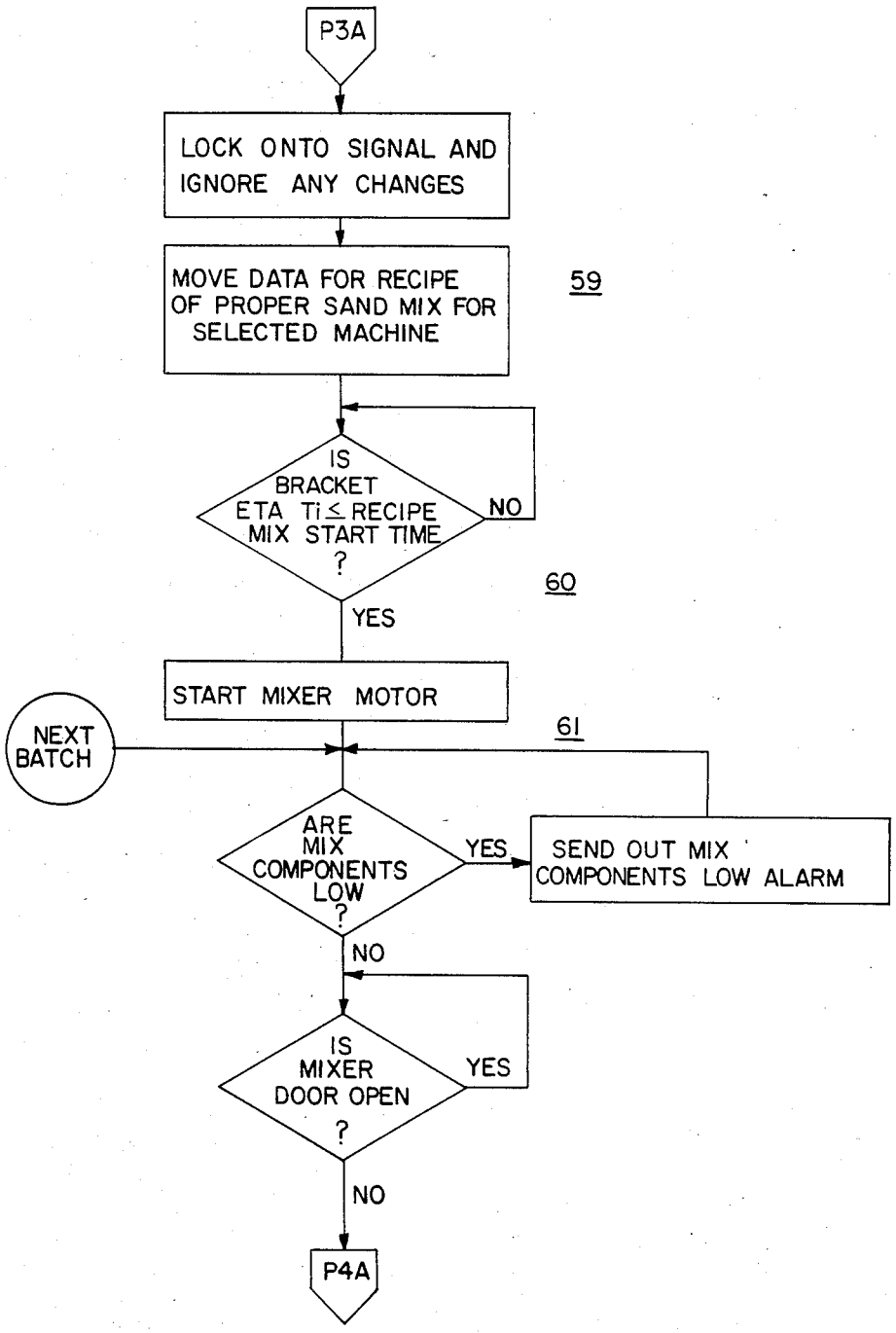
Figure 6D:
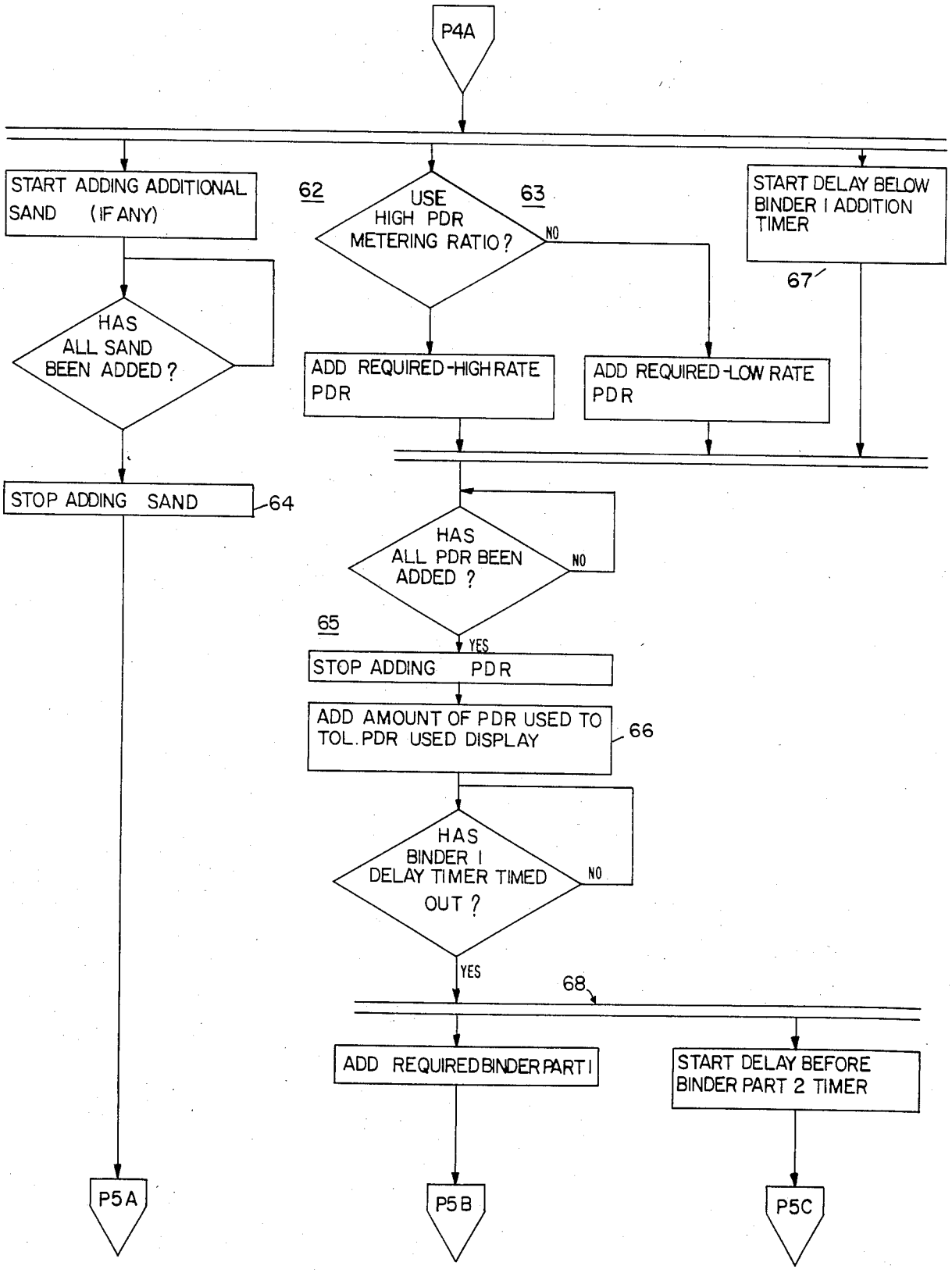
Figure 6E:
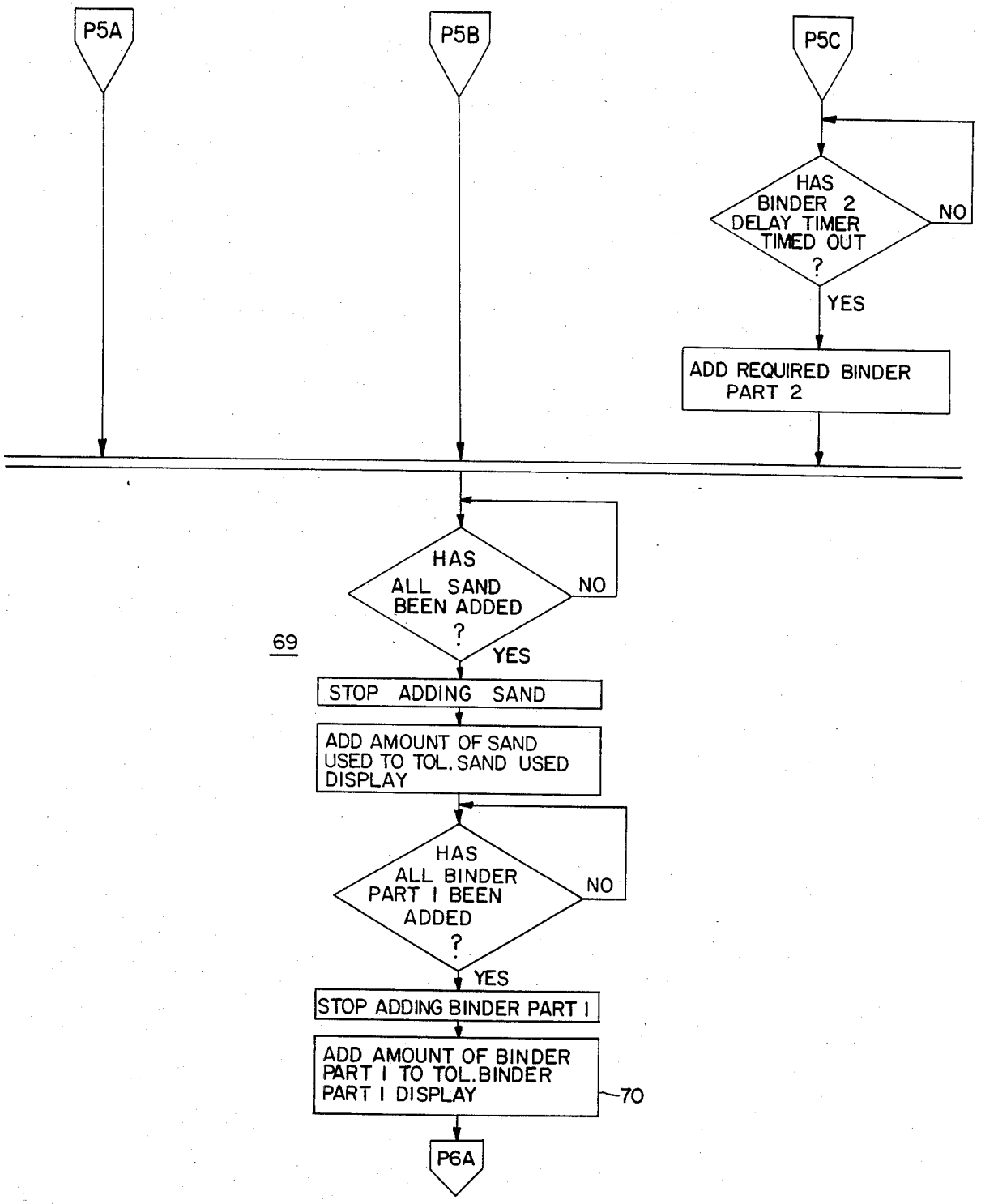
Figure 6F:
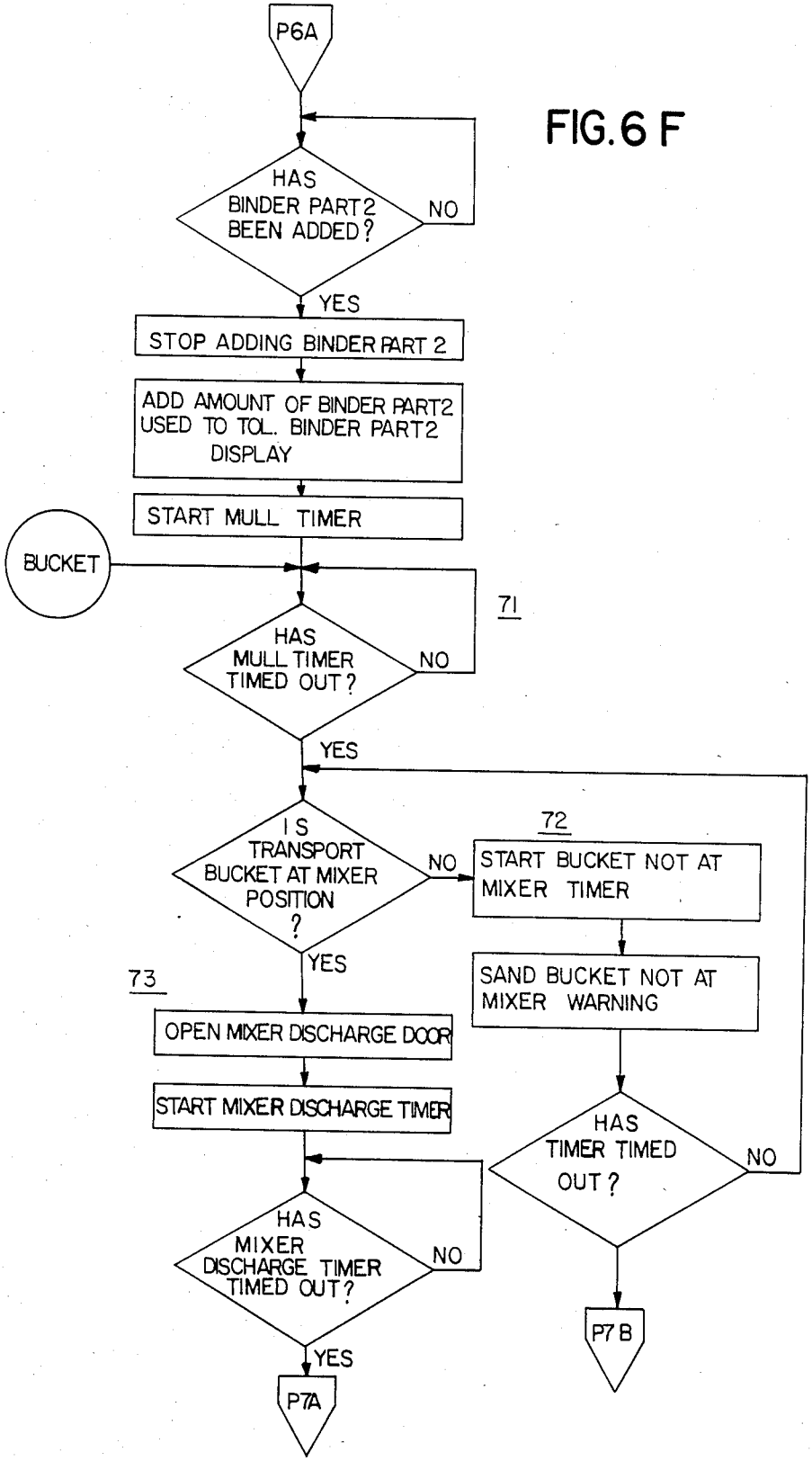
Figure 6G:
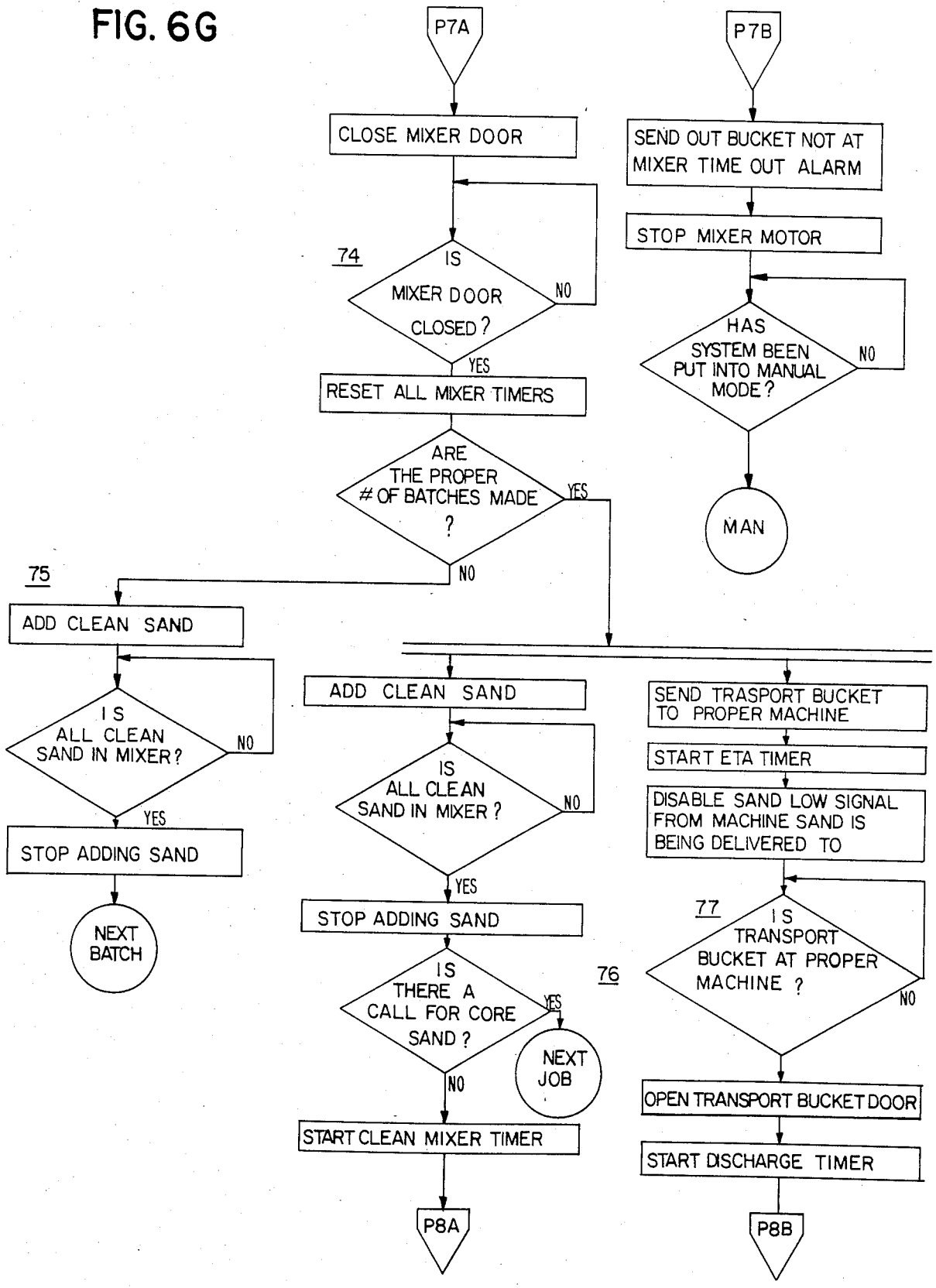
Figure 6H:
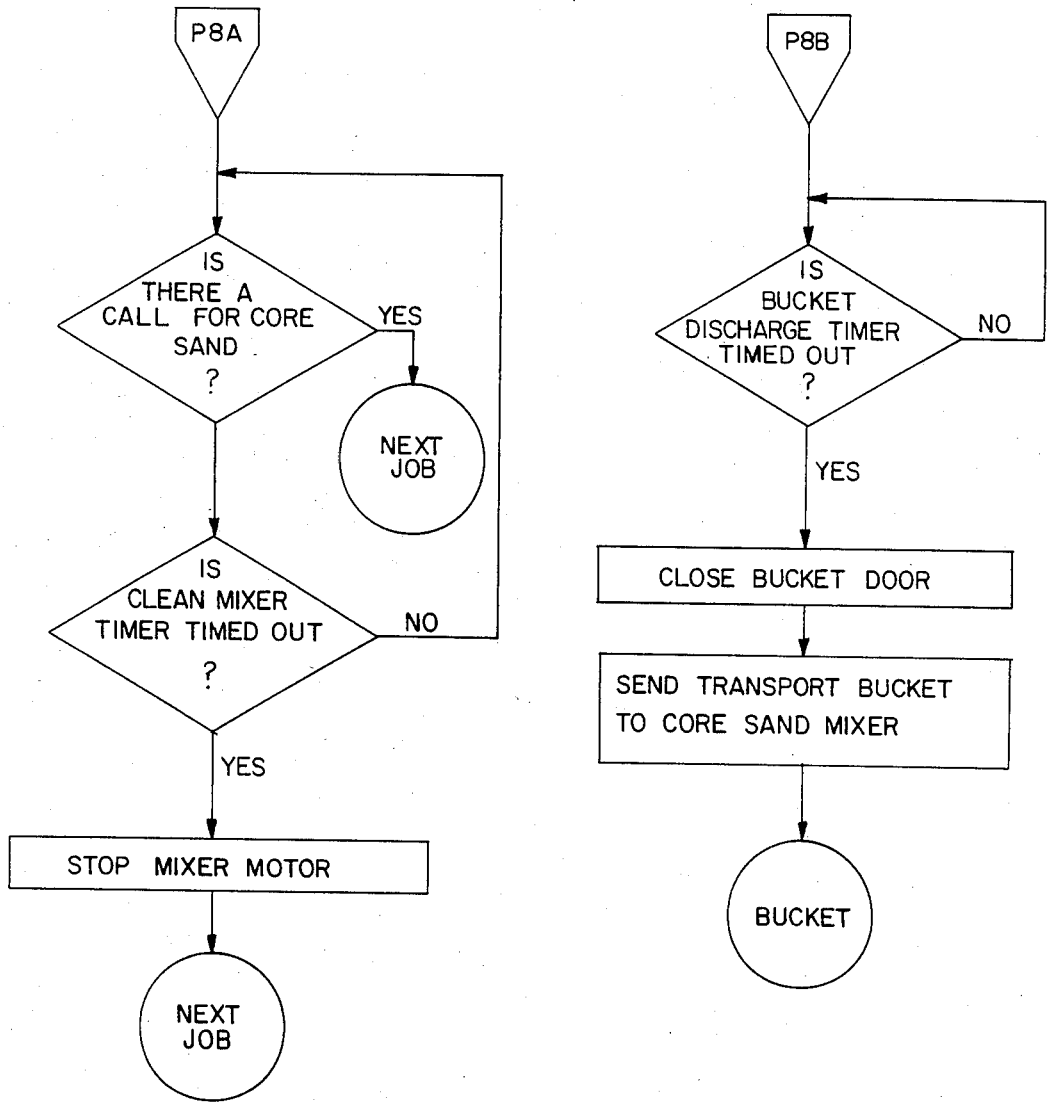

Referring to FIG. 3, the transport bucket 9 is supported on a monorail conveyor track 25 for lateral movement into alignment with the receiving hopper 26 on the several core machines. The bucket 9 has a bottom gate, which opens to drop the sand mix in the core machine.

More particularly the mixer is shown as a well-known conventional OMC mixer having a sand heater 17 at the upper end. A front discharge unit 28 is adapted to open and vertically drop the sand from the mixer 11 into the bucket 9. The sand is stored in a silo-type storage unit 29, and delivered to the mixer 11 by a bucket elevator 30 which provides for transfer of the clean sand to the mixer.

The transport bucket 9 is shown mounted on an overhead conveyor truck 25 by a suitable carriage 31. The bucket 9 is an open top bucket having the bottom discharge gate or door 32. The discharge door 32 is shown pivotally mounted. A hydraulic cylinder unit 33 is connected to the one side wall of the bucket 9 and is coupled to the door 32 for powered pivoting of the door about its pivot mount for opening and discharging of the sand.

Figure 4:
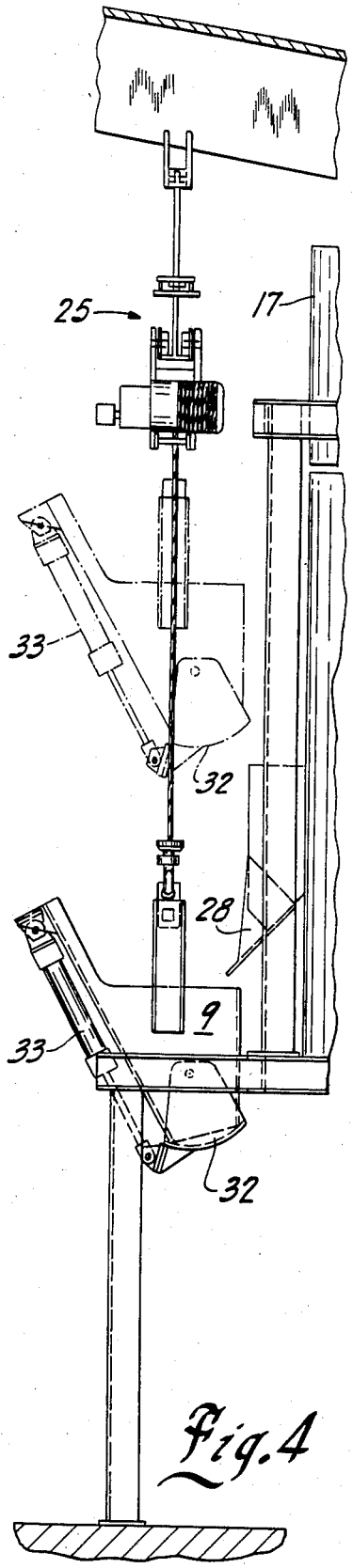
FIGS. 3 and 4 are a front and side elevational view of the bucket unit shown in FIGS. 1 and 2 more clearly illustrating the positioning and support thereof.

The bucket 9 is supported by a pair of side linkages 34, each of which is similarly constructed and connected between the bucket and the conveyor. Each linkage 34 consists of a pair of arms 35 pivotally interconnected to each other. One arm is connected to the side of the bucket 9 and the second arm is similarly pivotally connected to carriage 31 of the conveyor. The arms are angulated to define an outwardly projecting obtuse angle. Lifting upwardly on the arm causes the arms to pivot into a collapsed or folded position as shown in FIG. 4. To raise the bucket to the discharge position, the arms are retracted, thereby raising the bucket upwardly to a position immediately above the level of the core machine, as shown in FIG. 2. The bucket is raised and lowered by a suitable hoist unit.

Each core machine 2–5 is similarly arranged in longitudinal spaced alignment beneath the path of the transport bucket 9 Each machine includes a transfer head 26 in alignment with the path of the transport bucket for transfer of the sand mix to the box.

Each core machine is of any suitable construction which is adapted to receive the sand mix from the bucket 9 and to distribute the sand thoroughly to the box to conform to the pattern within the box. The core machine normally includes means to insure thorough transfer and movement of the sand about the patterns. The core machine is also connected to the source of the binder activating gas and after the sand mix is transferred to the core box, the gas is added through any suitable transfer means.

At the mixing station 1 the controller automatically monitors each of the core machines 2–5, each of which is constructed with a signal source 38 to initiate a sand demand signal such as upon actuation of a control by the operator to the controller 10. Upon receipt of such sand demand signal, the controller 10 automatically introduces the appropriate mix recipe into the control system and operates the sand mixer and associated equipment to develop the proper recipe. More particularly, the sand requires mixing clean sand with one or more additives and a binder. The particular recipes of sand molding mixtures are readily stored in the memory of a computer unit 10. In view of the very substantial number of different recipes which can be used and which may be varied based upon particular experience, the computer unit 10 includes a system for producing a particular recipe for a given core and core machine based on an inserted core machine code and a recipe code. Further, each recipe includes a selected batch size, with successive actuation of the system for multiple unit programmed batches. The computer program is shown in the accompanying flow charts (FIGS. 5A–5H and 6A–6H).

The following abbreviations have been used in the flow charts of FIGS. 5A–5H and 6A–6H for clarity of presentation:

| ABBREVIATIONS | |
|---|---|
| # = for number | Gas = Gas |
| #s = " numbers | Sand = Sand |
| --- move or transfer | Powder — PDR |

-continued

| ABBREVIATIONS | |
|---|---|
| Register = Reg. | Multiplier = Xer |
| four = 4 | Preset = Pre |
| Time = Ti | Timer = TMR |
| Blow = BL | constant = K |
| Base = BA | Total = Tol |
| Delay = Del. | Discharge = Dis |
| Request = Req | |

Generally, the program controls the quantity of each of the general ingredients or materials to be supplied to the mixer as well as the transport of the bucket and delivery of the sand to the core machines. For example, a program is established with a series of recipe numbers, each of which includes a purge and sand code number, a gas code number and a binder code number, in accordance with a preset system, which are manually inserted into the controller, as at 40. The entered recipe number is checked in the program to make sure that proper code numbers have been entered, as at 41. If any number is not an appropriate available number, an error signal, such as a light turn-on, is generated, as shown at 42. If a selection is appropriately entered, the code numbers are entered and appropriately processed by the computer program in an expansion system for generating the appropriate control for delivery and mixing of the proper sand mix and delivery of the final sand mix to the proper core machine. Although a series of component code numbers are used to define the recipe, a single code number could be used with the computer programmed with all the necessary data to directly select and establish the proper control. The present embodiment reflects the empirical factors involved in core and mold formation.

The recipe numbers are first appropriately decoded and transferred to the operating system of the logic controller. The gas code may be a 5 digit code which creates a basic multiplier for the blow time and gas time, a blow time base and a gas time base, all of which are stored in an appropriate register, as at 43. The purge and sand code may be a similar 5 digit code which also calls out three control numbers, including the purge multiplier, purge time base and the poundage sand base, as at 44. The binder code may be a four digit code including two digits for each of the powder base and binder base, as at 45. Thus, the basic multipliers may include three different proper values which are related to the particular core machine and sand core. The blow and gas multiplier is based on the lowest of three suitable time ranges for both the blow time and gas time, and the blow time and gas time numbers are equal to the actual time multiplied by the factor related to the different time ranges. Thus, the time ranges may be related to steps of 0.1 seconds, 0.2 seconds and 0.5 seconds for increasing ranges, with corresponding multipliers of 10, 5 and 2. Similarly, the purge time is encoded to the respective machine required time ranges for the particular core machines. The purge time ranges may also include three ranges which are in steps of 0.1, 0.4 and 1 second steps, and the purge time code equal to the purge time multiplied by the multipliers 10, 2.5 and 1. The batch size code sets the minimum and maximum allowable selection and the number of batches for a given sand mix. The powder and binder additives are encoded to the percentage figure. The proper fast or slow feed is automatically selected by the program as are the mull and discharge times based on the size of the batches. In summary, the computer 10 generates the particular preset times for each material delivery and sequence including the preset periods for the core machine gas timer, blow timer and the purge timer, with the optimum operation of the mixer and conveyor and immediate transfer of the fully mulled sand mix to the proper core machine as shown by the flow chart.

In the illustrated embodiment of the invention, a maximum weight of sand mixture may be made in any one batch. The program checks to determine that an excessive batch reqirement has not been specified, as at 46. The apparatus for example may be operable to provide 300 pounds of said maximum in any given cycle. The program thus checks to determine that the total weight requested does not exceed the permitted number of batches to generate a total batch.

If the total weight is above a selected level, the controller 10 provides sequential operation of the batching system to generate the total weight prior to release of the transport bucket for delivery of the sand mix. The program sets a sand timer to add sand in accordance with the demand less the weight of the predelivered clean sand, as at 47. After the sand delivery is checked, the logic controller 10 sets the powder and binder addition timers in accordance with the entered code numbers. The system includes a low flow rate timer and a high flow rate timer for delivery of the powder materials. The controller 10 selects and sets the appropriate timers to deliver the powder for a predetermined period, with the slow or fast timer selected based upon the quantity to be delivered, as shown in the flow chart section 49. The program then checks to determine and deliver the first and second parts of the binder to be added, beginning with section 50. The amount to be added is calculated based on the recipe and a delivery timer is actuated to deliver the first binder part, and subsequently the second binder part. After the powder and binder have been added, the program steps to set a mull timer which actuates the muller to mix the sand for a predetermined time, as at 51.

A discharge timer is now set as at 52 to discharge the sand mix from the mixer. The time to discharge the sand is based on all previous time cycles.

The programmed controller finally determines which core machine or box requested this sand mix, and all data is transferred to that machine's working register, as shown at 53. The program returns the mix selection program to the start point of the program, as at 54.

The flow chart for the operation of the core sand mixer system is shown in FIGS. 6A–6H. The program start first determines the start of the controls system, that is, whether the start or stop buttons have been pushed and whether the system controller is on. If the system controller is on, the unit stops to determine whether in a manual or automatic mode, and if in the automatic mode, whether in a calibrate mode, as shown at 55. If in a calibrate setting, the routine recycles until the system has been calibrated and the operator has set the machine to the automatic operating mode. At that time, the program establishes appropriate control signals to sequentially start the mixer motor, open the mixer discharge door to clean the mixer and start a discharge timer, as shown at 56. After the predetermined period of time, the mixer door is closed and addition of clean sand is initiated as shown at sequence 57. The program cycles a clean sand timer to clean the mixer and thereafter place it in a standby mode, or when in the automatic mode, the program immediately determines whether or not there is a call by a machine for a core sand mix, as shown at 58.

If one or more demands exist, the program selects the highest priority based on the sequence of demand signals received, as shown at 59, and locks onto such signal. The controller then stores the mix for that core box and otherwise ignores all other signals until the particular core sand recipe mix has been processed and delivered to the particular machine.

The mix production system includes drawing the recipe of the sand mix from memory for the selected core machine, and then proceeding to the batching process.

If the transport bucket is not at the mix station, the comtroller determines, from the state of the bucket timer, when the bucket is anticipated to arrive at the mix station with respect to the recipe mix time, as shown at 60. If the bucket is at the mixer or will arrive in less than the normal mix time, the program steps to immediately start the mixing motor and initiate the actual mixing process, as at 61. The availability of the necessary components is determined. If not available, an alarm is sounded. If the various components are available, the mixer door is checked to insure it is closed. Assuming the door is closed, the cycle is initiated to add sand, as at 62, and to monitor whether high or low rate powder flow is to be used and initiate the supply of the powder at the proper rate of addition, as at 63. Sand is added and the controller continues to monitor the sand as added until the proper addition has been made, at which time the transfer of sand from the supply to the mixer terminates, as at 64. Simultaneously, the controller processes the powder metering ratio, either at the high flow rate or at the low flow rate and terminates the addition of the powder, as at 65. The powder used is added to a "total" display at step 66. A binder delay cycle was created with the start of the sand and powder supply cycles, as shown at 67. When the binder delay timer has timed out, the controller proceeds to provide for the addition of the first binder and simultaneously starts a delay cycle for the second binder, as shown at 68. After the second binder delay timer times out, the second binder is added thereby conditioning the system to step to a final check phase, as at 69, during which the total sand which has been added is again checked and adds any additional sand required. Similarly, the program determines that the first and second binder parts were added, and if not, adds the necessary amount, as shown at 70. The mull timer, is then operated as at 71 to thoroughly mix the sand, powder and binder. After the mull timer times out, the program stops to transfer the core sand mix to the bucket 9 for transfer to the proper machine, as follows.

The monitor checks whether the bucket 9 is at the mixer 11. If the bucket 9 is not at the mixer, the controller 10 generates an alarm sequence which cycles until the bucket arrives or the system is placed into a manual mode, as shown at 72. If the transport monitor timer has not timed out, the controller recycles back to the main loop.

If this timer times out, the program sequences to stop the mixer motor and requires a manual mode setting. The bucket will normally return within the allotted time. Upon return, the controller 10 proceeds to open the mixer discharge door 28 to transfer the sand mix to the bucket 9 under a fixed discharge timer, as at 73.

Once the discharge timer has timed out, the program steps to close the mixer door 28 and after such door has been closed, as noted at sequence 74, all of the mixer timers are reset to prepare the system for subsequent cycle. The recipe is checked to insure that a proper number of batches have been made and transferred to the bucket. If not, sand is added in the normal operation as at 75 and the program recycles to complete another batch through a cycle as just described. If a proper number of batches have been produced, the program branches to provide for resetting of the mixer as at 76 and also for transport of the filled bucket to the proper core machine, as shown at 77.

A new batch cycle, as shown at 76, of course includes the addition of the clean sand and determination as to whether or not there is a call for core sand from another machine. If so, the controller appropriately cycles to make a new batch of core sand to the recipe for that core machine, with the sequence described above. If another core machine has not called for sand the controller initiates the clean sand delivery to the mixer and then place the system in standby.

The transport bucket sequence 77 starts a timer during which the bucket 9 travels to the selected core machine 2–5. During transport, the demand signal source from the receiving core machine to receive the filled bucket is disabled; thereby eliminating possible recycling of the mixture for that machine prior to desired time. When the transport bucket 9 arrives at the proper core machine 2–5 the bucket door opens and starts a fixed timer cycle to transfer the material to the core machine. The timer is monitored by the logic controller 10 and after the bucket timer times out, the bucket is closed and returned to the core sand mixer.

Thus, generally the core system mixer interface functions to make one or more batches to produce the total batch size as required by the recipe for the corresponding core machine. The system first starts the mixing motor and then meters the additional sand required and simultaneously meters the powder additive into the mixer. The mull mold timer is then activated for a short mull cycle, such as 5/10th of a second, after which the binder is introduced into the mixture, followed by actuation of the mull timer, addition of the second binder part and a final actuation of the mull timer. After the addition of the several materials and the final actuation of the mull timer, the mixer discharges the material to the transport bucket with an appropriate actuation of a vibrator for the duration of the discharge timer. The discharge timer will time out, closing the bucket door and terminating the operation of the vibrator. Closing of the door by actuating a suitable limit switch or the like, initiates movement of the transport bucket and the supply of a basic unit of clean sand to the mixer under control of the clean sand timer. If another batch demand exists, the mixer unit will initiate a second batch or enter a clean out cycle for the duration of the clean timer then stop and wait for the next batch instruction. If another batch is required the mixer unit only starts a new cycle, if the transport bucket will return within the batch cycle. Basically the transport bucket rests at the home position adjacent the mixture. Whenever the sand system is placed into the automatic mode and the mixer initiates operation the mixer will discharge clean sand into the bucket and reload with additional clean sand. The bucket door will also open to insure emptying any such clean sand and establish the system in a priority mixed batch state. The mixer of course completes the batch or batches required for the particular demand and transfers the material to the transport bucket. The transport bucket moves to the proper machine, transfers the material and recloses. Upon reclosing, the bucket automatically returns to the home position. Transport bucket moves under a timed control and thus the total time remaining for it to return to the home position is continuously monitored and reported.

A manual and calibration mode may be provided for manual operation of each function and for calibration of the various controls such as the sand powder and binder supply control means. In such a mode, the transfer bucket would also be manually controlled. Such mode would also permit extra sand clean-out cycles, allow for the sand discharge to empty the mixing bowl and permit later sand addition. These and similar systems can of course be incorporated in the overall system. As such sequence and systems will be readily understood by those skilled in the art from that already given, no further description thereof is given.

The present invention permits the sand, additive, and binder mix to be uniquely accomplished for each core run, and insures that only the binder essential for the run is used in the system. The program thus provides the necessary precision to insure the highest quality of castings and with minimum material for such quality. The computer directly provides for the automatic determination of the proper batch size for any particular machine and provides not only a precise delivery of sand but an automatic sequence to maintain the core machine with full supply. The system thus optimizes the overall productions system so as to not only minimize waste of material but maximum time efficiency.

The present invention provides automated formation of a clean sand core without deterioration in the quality or the results.

Various modes of carrying out the invention are contemplated as being within the scope of the following claims and particularly pointing out and distinctly claiming the subject matter which is regarded as the invention.

I claims:

1. Apparatus for making cores or molds for sand casting comprising a plurality of core machines located in a predetermined array, a mixer adapted to create a sand mix of a core sand and a sand binder in accordance with anyone of a plurality of predetermined recipes, each of said core machines having a demand signal source operable to create a demand for one of the recipes, transport means movable in a pattern between the mixer and all of said core machines, and a logic controller coupled to said core machines to respond to a demand for a recipe and having means to identify the recipe for a particular core machine and to actuate the mixer to develop a sand mix in accordance with said recipe and thereafter deliver said sand mix to the appropriate core machine.

2. The apparatus of claim 1 wherein said logic controller includes timer means for controlling the delivery of sand to the mixer, and for controlling the delivery of the binder to the mixer, a mull timer to control mixing of the sand and binder, and a transport timer for controlling the transport of the sand mix to the core machine and return thereof to the mixer.

3. The apparatus of claim 2 having a core machine code and wherein each of said recipes includes at least three identifying encoded indicia including a blow and gas code, a purge and sand weight code, and a binder code, said codes each establishing a plurality of timer controls for establishing the supply of sand and binder to said mixer.

4. Apparatus of claim 1 wherein said transport means has a home position at the mixer, means for monitoring the location of said transport means relative to said mixer and scheduled return time of said transport means to said mixer, means to actuate the mixer to develop a sand mix essentially only within a transport time period no greater than the time period required by a selected recipe.

5. The apparatus of claim 4 wherein said logic controller includes means for controlling the time of core purging of the core boxes, means for controlling timed delivery of actuating gas to the core boxes, and said controller having input means to establish even multiples of the time of core purging and the time of actuating gas delivery.

6. Automated apparatus for making a sand core or sand mold for sand casting comprising a plurality of core forming machines, each of which is adapted to formation of a particular sand mold and requiring a predetermined recipe of sand, binder and additives, memory means for storing a plurality of mix recipes of sand and binder and powder additives, each of which is related to a particular core, a mixer unit including a mixer and a means for delivering sand and at least one binder to said mixer unit, said mixer unit including means for selective addition of additives to said mixer unit and for thoroughly mixing of the sand, binder and additives, each of said core machines being operable to generate a demand signal for signalling said mixer unit to receive a sand mix related to said machine, a logic controller means for sequentially recording said signals and sequentially reading said memory means for actuating said mixer unit to generate said sand core mix to create a selected mixture and delivering said mix to said core machines in accordance with said demand signal, transport means movably mounted for movement from a home position to the core machines, said logic controller means automatically responding to a demand signal for actuating said mixer unit to withdraw the recipe for said core machine from said memory means and operable to combine sand, binder and additive to generate said sand mix, deliver the sand mix to the transport means and cause said transport means to move from said home position to the selected core machine and automatically return to the home position.

7. The apparatus of claim 6 wherein said logic controller means includes means to monitor the positon of said transport means and to control the initiation of the mixer unit in relation to the time movement of the transport means from the core machine to the mixer unit such that the mixer unit completes a mixing cycle only with said transport means located at the mixer unit.

8. The apparatus of claim 7 wherein said home position is adjacent the mixing unit and said transport means is located in position to receive the mix from the mixer unit at said home position.

9. The apparatus of claim 6 including a mulling means for thoroughly mixing the sand, binder and additives in said mixer unit and a sand source, an additive source and a binder source to form said mix, said logic controller being operable to actuate the sand source and the additive source to simultaneously supply sand and additive to said mixer unit, to activate the mulling means after supplying said sand and additive, to supply binder to said mixer unit and to activate the mulling means after said supplying said binder.

10. The apparatus of claim 6 wherein the sand in any given recipe includes at least a base quantity of sand, said logic controller means actuating said sand source to supply said base quantity to the mixer unit immediately upon discharge of a mix by said transport means.

11. The apparatus of claim 10 wherein said binder source separately supplies separate interactive parts of a binder, and wherein said logic controller means actuates said mulling means after the addition of each of said binders.

12. The apparatus of claim 6 including means for controlling the rate of supply of additives, said logic controller means actuating said last named means in accordance with the quantity of total additive in the recipe.

13. The apparatus of claim 6 including a transport timer means preset to the time required for the transport means to deliver the sand mix to a core machine and return to said home position, and said logic controller means being operable to initiate operation of said mixer unit in response to a demand signal for a mix forming cycle only when said cycle time is no greater than the time required for the transport means to return to the home position.

14. The apparatus of claim 13 wherein said transport means includes discharge means, and said logic controller means operates at initial start-up to discharge any clean sand to said transport means and to reload said mixer unit with said base quantity and to discharge the clean sand from the transport means to insure a proper start state for the demanded mix.

15. Apparatus for making sand casting cores or molds comprising a plurality of core machines located in an in-line array, each of said core machines having a demand signal source, a mixer unit adapted to create a sand mix of a core sand and at least one powder additive and a sand binder in accordance with anyone of a plurality of predetermined recipes, said mixer unit being centrally located along said array of core machines, transport means movable between the mixer unit and all of said core machines, said core machines being coupled to at least one activating gas source for activating said binder, a logic controller having means to continuously read a demand signal from said machine demand signal sources and operable to respond to a demand signal from each machine and having means to identify the recipe for a particular core machine and to actuate the mixer unit to develop a sand mix in accordance with said recipe and transfer the mix to thereafter actuate the transport means to deliver said sand mix to the appropriate core machine, said logic controller controlling said gas source to supply actuating gas to a core machine upon delivery of the sand mix to the core machine.

16. The apparatus of claim 15 wherein each of said recipes includes at least four identifying encoded indicia including a core machine code, a gas code, a sand code, and a mixer timer code, said gas and mixer timer codes each establishing a plurality of timer controls for establishing the supply of sand, binder and additives to said mixer unit.

17. Automated apparatus for making a sand core or mold for sand casting comprising a memory means for storing a plurality of mixed recipes of a clean sand, powder additives and sand binders, each of which is related to a particular core machine, a plurality of core forming machines, each of which is adapted to formation of a particular sand mold and requiring a predetermined recipe of sand, binder and additives, a mixer unit including a mixer and a means for delivering sand and at least one binder to said mixer unit, said mixer unit including means for selective addition of additives to said mixer unit and for thoroughly mixing of the sand, binder and additives, each of said core machines being operable to generate a demand signal for signalling said mixer unit to receive a sand mix related to said machine, and logic controller means for sequentially recording said signals and sequentially reading said memory means for actuating said mixer unit to generate said sand core mixes and delivering said mixes to said core machines in accordance with said demand signals.

18. The apparatus of claim 17 having a transport bucket means movably mounted for movement from the mixer unit to the core machines, said mixer unit to withdraw the recipe for said core machine from said memory means and operable to combine sand, binder and additive to generate the sand mix, deliver the sand mix to the transport bucket means and cause said transport bucket means to move said sand mix to the core machine and automatically return to the mixer unit, said logic controller means including means to monitor the positon of said transport bucket means and to control the initiation of the mixer unit in relation to the time movement of the bucket means from the core machine to the mixer unit.

* * * * *